US010010781B1

(12) United States Patent
Tiernan

(10) Patent No.: US 10,010,781 B1
(45) Date of Patent: Jul. 3, 2018

(54) LASER SYSTEM FOR A PUTTER

(71) Applicant: Mark Wreford Tiernan, Missouri city, TX (US)

(72) Inventor: Mark Wreford Tiernan, Missouri city, TX (US)

( * ) Notice: Subject to any disclaimer, the term of this patent is extended or adjusted under 35 U.S.C. 154(b) by 0 days.

(21) Appl. No.: 15/680,405

(22) Filed: Aug. 18, 2017

(51) Int. Cl.
*A63B 69/36* (2006.01)
*A63B 53/00* (2015.01)

(52) U.S. Cl.
CPC ..... *A63B 69/3614* (2013.01); *A63B 53/007* (2013.01)

(58) Field of Classification Search
USPC ..... 473/219, 220, 226, 27, 266, 268
See application file for complete search history.

(56) References Cited

U.S. PATENT DOCUMENTS 3,810,633 A * 5/1974 Scott, III ..... A63B 69/3685 473/240
5,611,739 A * 3/1997 Carney ..... A63B 69/3614 473/220
5,709,609 A * 1/1998 Carney ..... A63B 69/3614 362/259
5,725,439 A * 3/1998 Halsey ..... A63B 69/3614 362/259
6,371,864 B1 * 4/2002 Norwood ..... A63B 69/3685 473/220
8,303,427 B1 * 11/2012 High ..... A63B 69/3685 473/119
2004/0033842 A1 * 2/2004 Collins ..... A63B 69/3614 473/220

* cited by examiner

*Primary Examiner* — Nini Legesse
(74) *Attorney, Agent, or Firm* — Plager Schack LLP

(57) ABSTRACT

An adjustable laser sight for a putter is configured to displays a visible line of sight from the putter to a hole. The adjustable laser sight includes a housing that is generally hollow. The housing further comprises a module first slot, a first leg, a second leg, and a first slot. A laser line module is inserted into the module first slot. A lower plate is connected to the housing. A back plate is fit against the lower plate. The back plate is along the lower plate relative to the housing. The adjustable laser sight is configured to be held to the putter between the first leg, the second leg and a spring loaded lower plate third leg such that the laser line module produces a projected line of sight which makes the visible line of sight from the putter to the hole.

3 Claims, 5 Drawing Sheets

FIG.1
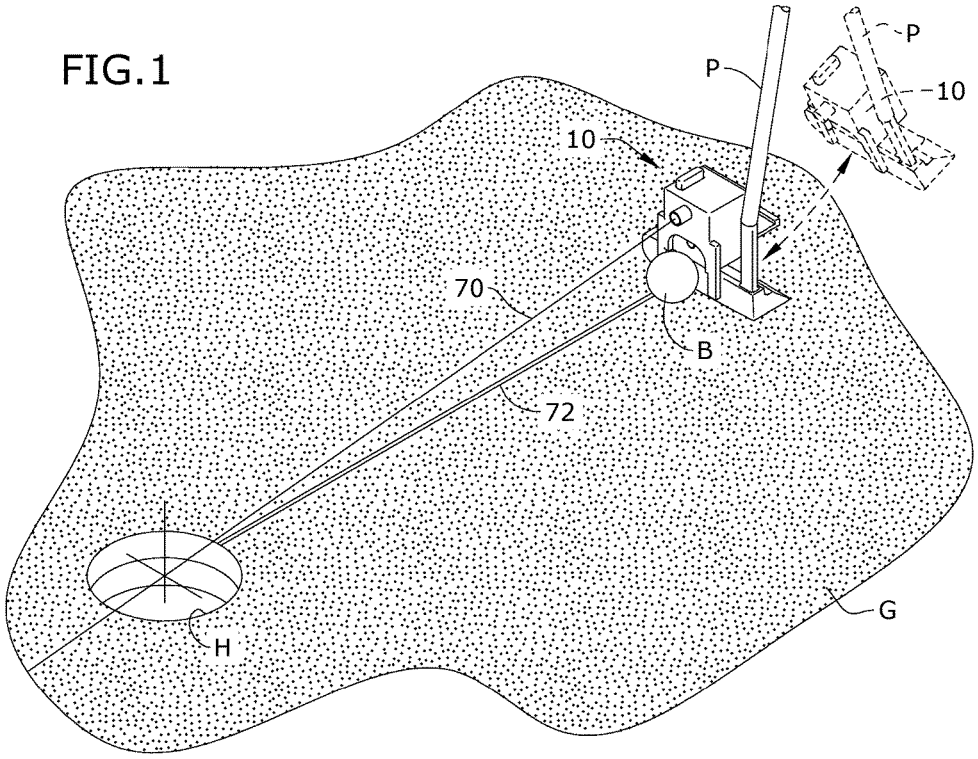
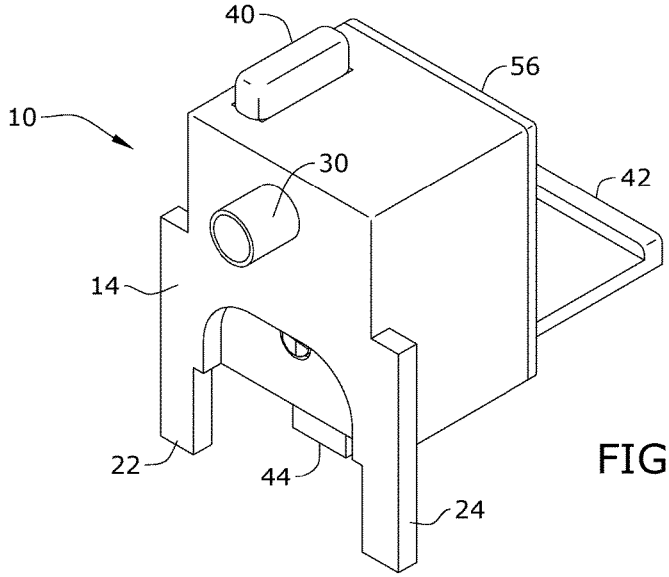
FIG.2

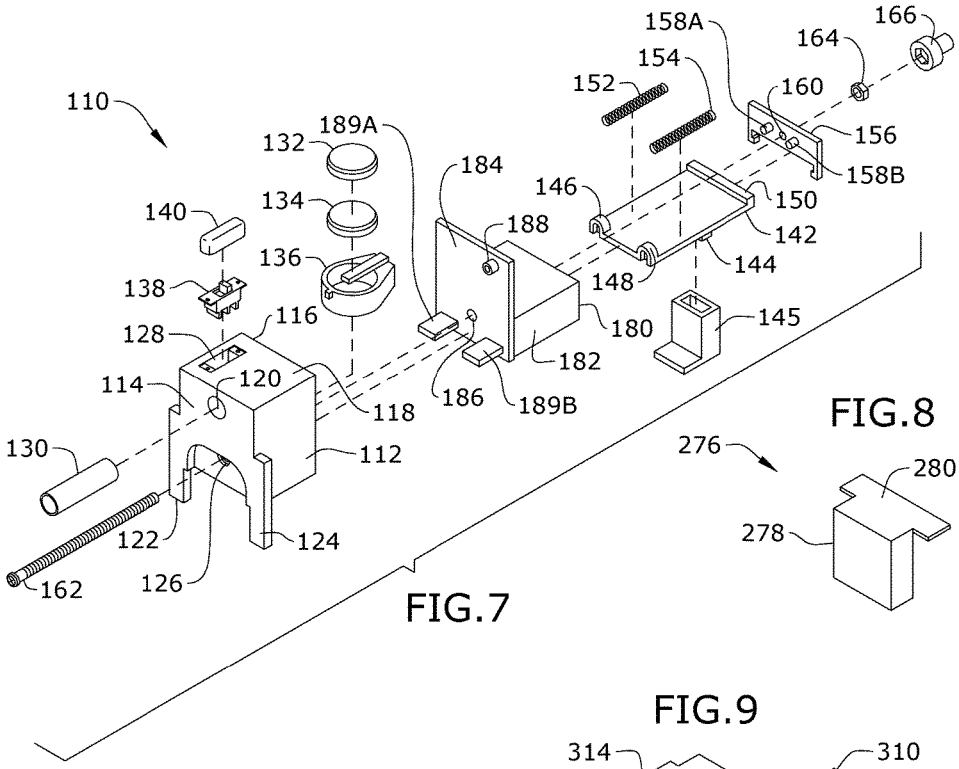
FIG.7
FIG.8
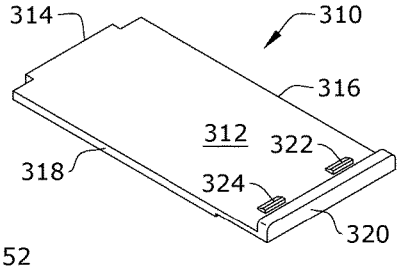
FIG.9
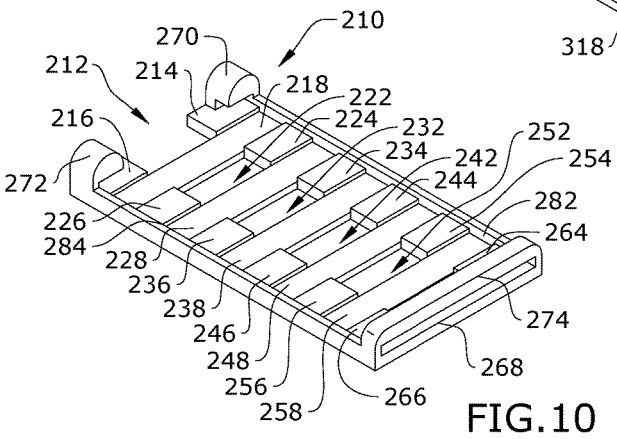
FIG.10

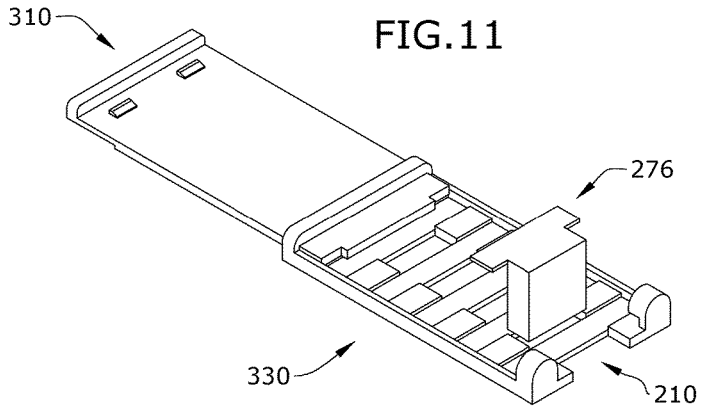
FIG.11
FIG.12
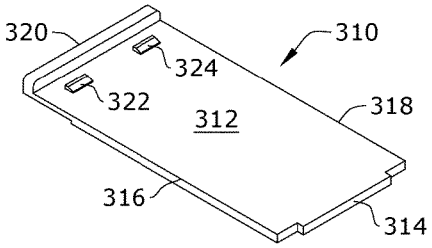
FIG.14
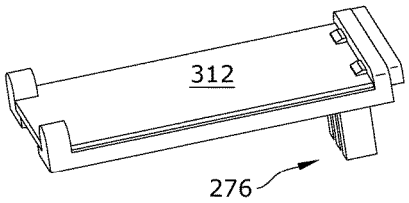
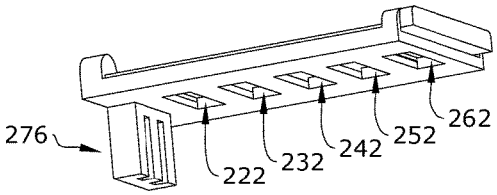
FIG.13
FIG.15
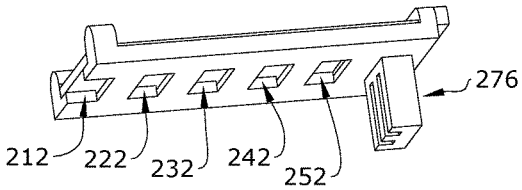

LASER SYSTEM FOR A PUTTER

RELATED APPLICATION

This application claims priority to provisional patent application U.S. Ser. No. 62/401,008 filed on Sep. 28, 2016, the entire contents of which is herein incorporated by reference.

BACKGROUND

The embodiments herein relate generally to golfing tools and accessories.

Prior to embodiments of the disclosed invention laser-guided putters provided minimum guidance in form of a dot, requiring another solid surface for viewing. In addition, these devices attached to a shaft of the putter that required extensive alignment on part of the user and provided no assistance on the location on the putter face where the ball is being hit. Embodiments of the disclosed invention solve this problem.

SUMMARY

An adjustable laser sight for a putter is configured to displays a visible line of sight from the putter to a hole. The adjustable laser sight includes a housing that is generally hollow. The housing further comprises a module first slot, a first leg, a second leg, and a first slot. A laser line module is inserted into the module first slot. A lower plate is connected to the housing. A back plate is fit against the lower plate. The back plate is along the lower plate relative to the housing. The adjustable laser sight is configured to be held to the putter between the first leg, the second leg and a spring loaded lower plate third leg such that the laser line module produces a projected line of sight which makes the visible line of sight from the putter to the hole.

BRIEF DESCRIPTION OF THE FIGURES

The detailed description of some embodiments of the invention is made below with reference to the accompanying figures, wherein like numerals represent corresponding parts of the figures.

FIG. 1 shows a perspective view of one embodiment of the present invention shown in use;

FIG. 2 shows a perspective view of one embodiment of the present invention;

FIG. 7 shows an exploded view of one embodiment of the present invention;

FIG. 8 shows a perspective view of one embodiment of a component of the present invention;

FIG. 9 shows a perspective view of one embodiment of a component of the present invention;

FIG. 10 shows a perspective view of one embodiment of a component of the present invention;

FIG. 11 shows a perspective view of one embodiment of a component of the present invention;

FIG. 12 shows a perspective view of one embodiment of a component of the present invention;

FIG. 13 shows a perspective view of one embodiment of a component of the present invention;

FIG. 14 shows a perspective view of one embodiment of a component of the present invention; and FIG. 15 shows a perspective view of one embodiment of a component of the present invention.

DETAILED DESCRIPTION OF CERTAIN EMBODIMENTS

Figure 3:
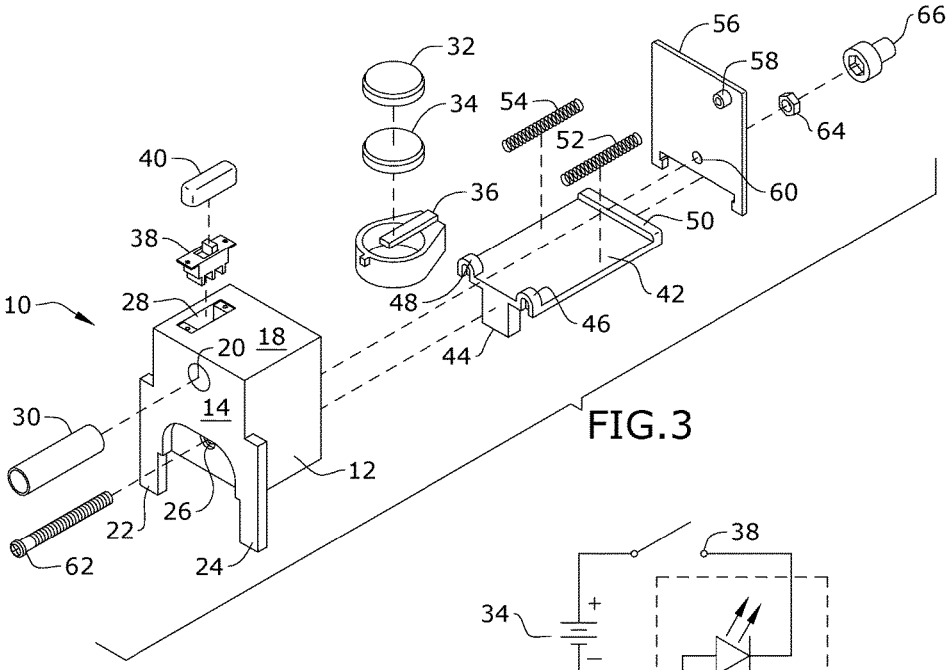
FIG. 3 shows an exploded view of one embodiment of the present invention.
Figure 6:
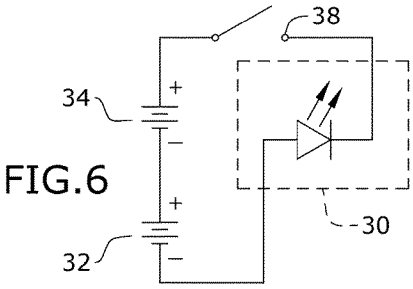
FIG. 6 shows an electrical schematic of one embodiment of the present invention.
Figure 4:
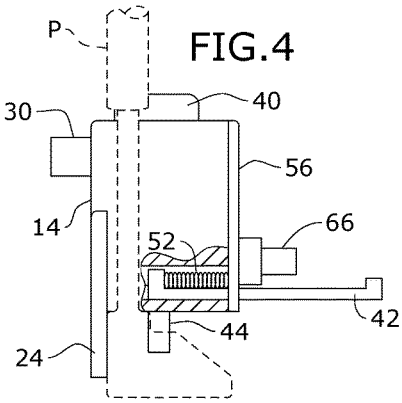
FIG. 4 shows a side view of one embodiment of the present invention.
Figure 5:
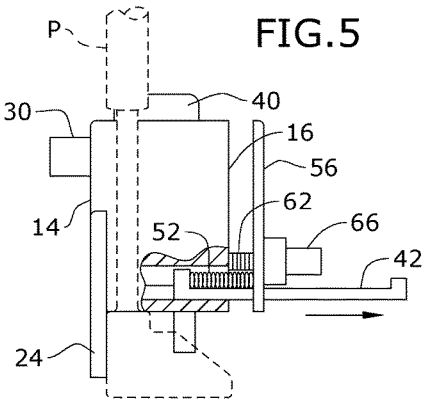
FIG. 5 shows a side view of one embodiment of the present invention.

By way of example, and referring to FIG. 1, a user desires to put ball B on green G with putter P into hole H. Adjustable laser sight 10 displays a projected line of sight 70 which, when looking from above, appears as a visible line of sight 72. The visible line of sight 72 connects the ball B with the hole H at 90 degrees relative to the putter face.

As shown in FIGS. 2-6, one embodiment of an adjustable laser sight 10 comprises a housing 12. The housing 12 is generally hollow and further comprises a front side 14, a rear side 16, and a top side 18. Other sides can exist to form a modified parallelepiped. The front side 14 further comprises a module first slot 20, a first leg 22, second leg 24, and a first slot 26. The top side 18 further comprises a switch first slot 28. In some embodiments, a distance between leg 22 and leg 24 can be 1.4 inches to provide feedback on hitting the ball B in the center of the putter P.

A laser line module 30 is inserted into the module first slot 20. A first battery 32, and a second battery 34 are inserted into a power supply 36, which is then electrically coupled to the laser line module 30. A switch 38 is inserted into the switch first slot 28 and electrically coupled to the power supply 36 and the laser line module 30. The switch can be covered with a switch cap 40.

A lower plate 42 further comprises a third leg 44. The lower plate 42 further comprises a first front spring notch 46, a second front spring notch 48 and a rear notch 50. A first spring 52 fits between the first front spring notch 46 and the rear notch 50. A second spring 54 fits between the second front spring notch 48 and the rear notch 50. A back plate 56 fits against the lower plate 42 between the first spring 52, the second spring 54 and a nut 64. The notch 50 is intended for the user to be able to pull back the pressure plate 42 when attaching the putter P. The back plate 56 further comprises a second slot 60.

A bolt 62 comprises threads and can be threaded through the first slot 26 and second slot 60. The bolt 62 is then held in place with a nut 64 and a nut cap 66.

Figure 16:
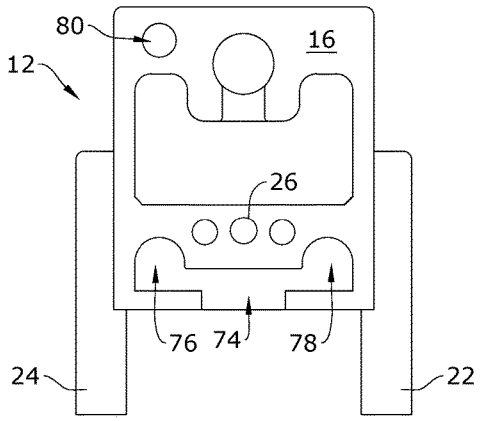
FIG. 16 shows a rear view of one embodiment of a component of the present invention.
Figure 17:
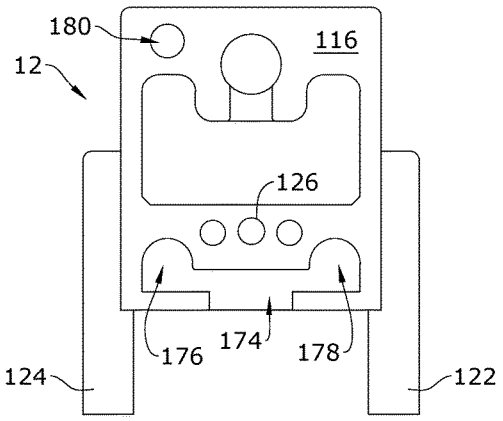
FIG. 17 shows a rear view of one embodiment of a component of the present invention.

FIG. 16 shows the rear side 16 of the housing 12. Lower slot 74 further comprises a first lower slot opening 76 which is adapted to receive the first front spring notch 46. Lower slot 74 further comprises a second lower slot opening 78 which is adapted to receive the second front spring notch 48. It follows that the lower plate 42 slides into the lower slot 74 therebetween. The rear side 16 further comprises an alignment segment opening 80 which is adapted to receive the alignment segment 58.

Turning to FIG. 7, adjustable laser sight 110 comprises a housing 112. The housing 112 is generally hollow and further comprises a front side 114, a rear side 116, and a top side 118. Other sides can exist to form a modified parallelepiped. The front side 114 further comprises a module first slot 120, a first leg 122, second leg 124, and a first slot 126. The top side 118 further comprises a switch first slot 128.

A laser line module 130 is inserted into the module first slot 120. A first battery 132, and a second battery 134 are inserted into a power supply 136, which is then electrically coupled to the laser line module 130. A switch 138 is inserted into the switch first slot 128 and electrically coupled to the power supply 136 and the laser line module 130. The switch can be covered with a switch cap 140.

A lower plate 142 further comprises a third leg 144 which can be attached to a clip extension 145. The lower plate 142 further comprises a first front spring notch 146, a second front notch 148 and a rear notch 150. A first spring 152 fits between the first front spring notch 146 and the rear notch 150. A second spring 154 fits between the second front spring notch 148 and the rear notch 150. A back plate 156 fits against the lower plate 142 between the first spring 152, the second spring 154 and the rear notch 150. The back plate 156 further comprises a first alignment segment 158A and a second alignment segment 158B which are adapted to fit into an alignment first slots on a rear side 180 of a housing extension 182. The back plate 156 further comprises a second slot 160.

The housing extension 182 further comprises a central plate 184. The central plate 184 further comprises a third slot 186 and an alignment segment 188 which is adapted to fit into an alignment slot 180 on the rear side 116. The housing extension 182 further comprises a first alignment segment 189A that is adapted to fit into the second lower slot opening 178 on the rear side of 116. The housing extension 182 further comprises a second alignment segment 189B that is adapted to fit into the first lower slot opening 176 on the rear side of 116. A bolt 162 comprises threads and can be threaded through the first slot 126, the third slot 186 and the second slot 160. The bolt 162 is then held in place with a nut 164 and a nut cap 166.

Figure 18:
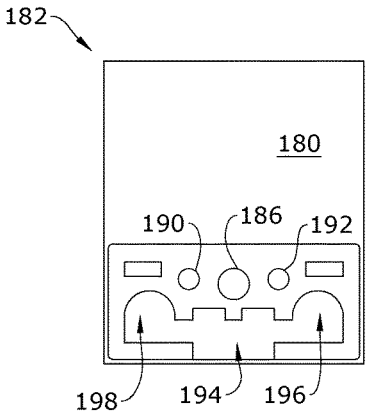
FIG. 18 shows a rear view of one embodiment of a component of the present invention.

FIG. 18 shows the rear side 180 of the housing extension 182. Lower slot 194 further comprises a first lower slot opening 196 which is adapted to receive first front spring notch 146. Lower slot 194 further comprises a second lower slot opening 198 which is adapted to receive the second front spring notch 148 with the lower plate 142 fitting therebetween. The rear side 180 further comprises a first alignment segment opening 192 which is adapted to receive the first alignment segment 158A. The rear side 180 further comprises a second alignment segment opening 190 which is adapted to receive the second alignment segment 158B.

Turning to FIGS. 8-15, lower plate 210 further comprises a first drop point 212 set between a first raised section 214, a second raised section 216 and a first lowered section 218. A second drop point 222 is set between a third raised section 224, a fourth raised section 226 the first lowered section 218, and a second lowered section 228. A third drop point 232 is set between a fifth raised section 234, a sixth raised section 236 the second lowered section 228, and a third lowered section 238. A fourth drop point 242 is set between a seventh raised section 244, an eighth raised section 246 the third lowered section 238, and a fourth lowered section 248. A fifth drop point 252 is set between a ninth raised section 254, a tenth raised section 256, the fourth lowered section 248, and a fifth lowered section 258. A sixth drop point 262 is set between an eleventh raised section 264, a twelfth raised section 266, the fifth lowered section 258, and a sixth lowered section 268. The first raised section 214 is mechanically coupled to a first front spring notch 270. The second raised section 216 is mechanically coupled to a second front spring notch 272. The sixth lowered section 268 is mechanically coupled to a notch first slot 274.

A clip extension 276 further comprises a clip base 278 and a clip top 280. The clip base can slide into the first drop point 212, the second drop point 222, the third drop point 232, the fourth drop point 242, the fifth drop point 252, and the sixth drop point 262. The clip top 280 can rest upon the first lowered section 218, the second lowered section 228, the third lowered section 238, the fourth lowered section 248, the fifth lowered section 258, or the sixth lowered section 268.

The lower plate 210 further comprises a lower plate first channel 282 and a lower plate second channel 284. An upper plate 310 further comprises a base surface 312 mechanically coupled to a front key 314, a first side notch 316, second side notch 318, rear notch 320, rear first side notch 322, and rear second side notch 324.

To assemble a plate assembly 330, the upper plate 310 is slid into the notch first slot 274 until the rear notch 320 contacts the notch first slot 274. At this point, the lower plate first channel 282 will be filled with the first side notch 316. The lower plate second channel will be filled with the second side notch 318 and the front key 314 will be between the first front spring notch 270 and the second front spring notch 272.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An adjustable laser sight for a putter; configured to displays a visible line of sight from the putter to a hole; the adjustable laser sight comprising:

a housing that is generally hollow; wherein the housing further comprises a module first slot, a first leg, a second leg, and a first slot; wherein the housing further comprises a front side, a rear side, and a top side; wherein the front side further comprises the module first slot, the first leg, the second leg, and the first slot; wherein the top side further comprises a switch first slot;

a first battery and a second battery, inserted into a power supply, which is then electrically coupled to the laser line module; and a switch, is inserted into the switch first slot and electrically coupled to the power supply and the laser line module a laser line module, inserted into the module first slot;

a lower plate, connected to the housing; the lower plate further comprising a third leg, a first front spring notch, a second front spring notch and a nut;

a back plate, fit against the lower plate;

a first spring, fit between the first front spring notch and the back plate; and a second spring, fit between the second front spring notch and the back plate;

wherein the adjustable laser sight is configured to be held to the putter between the first leg, the second leg and a third leg such that the laser line module produces a projected line of sight which makes the visible line of sight from the putter to the hole.

2. The adjustable laser sight of claim 1, wherein the back plate is located between the first spring, the second spring, and the nut;

wherein the back plate further comprises an alignment segment which is adapted to fit into a first alignment segment opening on the rear side; and wherein the back plate further comprises an second slot.

3. The adjustable laser sight of claim 2, further comprising a threaded bolt that is inserted through the first slot and the second slot; wherein the bolt is held in place with a second nut and a nut cap.

* * * * *